US009364134B2

(12) United States Patent
Kim

(10) Patent No.: US 9,364,134 B2
(45) **Date of Patent: *Jun. 14, 2016**

(54) DISHWASHER HAVING DRYING DEVICE

(71) Applicant: SAMSUNG ELECTRONICS CO., LTD., Suwon-si, Gyeonggi-do (KR)

(72) Inventor: Sung Jin Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/276,169

(22) Filed: May 13, 2014

(65) Prior Publication Data

US 2014/0246061 A1 Sep. 4, 2014

Related U.S. Application Data

(63) Continuation of application No. 12/926,413, filed on Nov. 16, 2010, now Pat. No. 8,758,525.

(30) Foreign Application Priority Data

Nov. 30, 2009 (KR) ..... 10-2009-116895

(51) Int. Cl.
*A47L 15/48* (2006.01)

(52) U.S. Cl.
CPC ..... *A47L 15/483* (2013.01); *A47L 15/486* (2013.01); *A47L 15/488* (2013.01)

(58) Field of Classification Search
CPC .... A47L 15/483; A47L 15/486; A47L 15/488
USPC ..... 134/57 D, 58 D, 56 D, 95.2, 99.1, 105
See application file for complete search history.

(56) References Cited

U.S. PATENT DOCUMENTS 5,337,500 A 8/1994 Enokizono
5,341,827 A 8/1994 Kim (Continued)

FOREIGN PATENT DOCUMENTS

EP 239012 9/1987
EP 521815 1/1993

(Continued)

OTHER PUBLICATIONS

European Search Report issued Apr. 27, 2011 in corresponding European Patent Application No. 10192130.3.

(Continued)

*Primary Examiner* — Alexander Markoff
(74) *Attorney, Agent, or Firm* — Staas & Halsey LLP

(57) ABSTRACT

A dishwasher includes a cabinet; a washing tub provided at an inside of the cabinet; a sump provided at a lower side of the washing tub to store wash water; a heater to heat the wash water; a spray nozzle configured to spray the heated wash water that is pumped from the sump toward inside of the washing tub; and a door configured to open and close a front of the washing tub, the door including a drying device configured to cool high-temperature/high-humidity air from the washing tub and then to discharge the cooled air outside of the dishwasher. The drying device includes a condensation duct to condense the high-temperature/high-humidity air from the washing tub; a first fan to draw in air from the washing tub to the condensation duct; and a second fan to draw in external air to the condensation duct.

5 Claims, 9 Drawing Sheets

(56) References Cited

U.S. PATENT DOCUMENTS

| | | | | |
|---|---|---|---|---|
| 5,660,195 | A | 8/1997 | Taylor et al. | |
| 5,881,746 | A | 3/1999 | Buser et al. | |
| 8,758,525 | B2 * | 6/2014 | Kim | 134/57 D |
| 2006/0231122 | A1 | 10/2006 | Steizer et al. | |
| 2007/0006898 | A1 * | 1/2007 | Lee | 134/10 |
| 2007/0251552 | A1 | 11/2007 | Lee | |
| 2008/0087307 | A1 | 4/2008 | Han et al. | |
| 2008/0264455 | A1 | 10/2008 | Brewer et al. | |
| 2008/0264458 | A1 | 10/2008 | Berner et al. | |
| 2010/0083991 | A1 | 4/2010 | Tolf | |
| 2010/0095989 | A1 | 4/2010 | Han et al. | |
| 2010/0132217 | A1 | 6/2010 | Steffens | |

FOREIGN PATENT DOCUMENTS

| | | | |
|---|---|---|---|
| EP | 1 721 559 | | 11/2006 |
| EP | 1 961 361 | | 8/2008 |
| KR | 10-2002-0047870 | | 6/2002 |
| KR | 10-0517737 | B1 * | 9/2005 |
| KR | 10-2008-0028526 | | 4/2008 |
| KR | 10-2008-0083393 | | 9/2008 |

OTHER PUBLICATIONS

US Office Action issued Apr. 25, 2013 in copending U.S. Appl. No. 12/926,413.

US Office Action issued Oct. 4, 2013 in copending U.S. Appl. No. 12/926,413.

US Notice of Allowance issued Feb. 14, 2014 in copending U.S. Appl. No. 12/926,413.

U.S. Appl. No. 12/926,413, filed Nov. 16, 2010, Sung Jin Kim, Samsung Electronics Co., Ltd.

* cited by examiner

DISHWASHER HAVING DRYING DEVICE

CROSS-REFERENCE TO RELATED APPLICATIONS

This application is a continuation of U.S. application Ser. No. 12/926,413, filed on Nov. 16, 2010, which claims the benefit of Korean Patent Application No. 10-2009-0116895, filed on Nov. 30, 2009 in the Korean Intellectual Property Office, the disclosures of which are incorporated herein by reference.

BACKGROUND

1. Field

Example embodiments relate to a dishwasher having an improved drying device to dry dishes.

2. Description of the Related Art

Dishwashers are apparatuses which hygienically and efficiently wash dishes, i.e., electric home appliances spraying wash water onto dishes to remove contaminants from the dishes.

A dishwasher performs a washing operation to wash dishes, a rinsing operation to rinse the dishes, and a drying operation to dry the dishes.

Particularly, during the drying operation, the dishwasher may use a drying method using a heater and a drying method using latent heat. The former method is a method of drying dishes using additional energy supplied by operating the heater, while the latter method is a method of drying dishes using latent heat in the dishes without additional energy.

Further, in order to discharge high-temperature air contained in the dishwasher outside of the dishwasher, a ventilation method and a condensation method may be used. In the ventilation method, high-temperature air is discharged directly outside of the dishwasher. In the condensation method, high-temperature air is circulated into a condensation duct and is then discharged outside of the dishwasher.

SUMMARY

Therefore, it is an aspect of the example embodiments to provide a dishwasher including a drying device, which cools the temperature of high-temperature and high-humidity air and then discharges the air outside of the dishwasher, and a control method of the dishwasher.

The foregoing and/or other aspects are achieved by providing a dishwasher including a cabinet, a washing tub provided in the cabinet, a condensation duct to cool air in the washing tub and to discharge the cooled air outside of the dishwasher, the condensation duct including a guide duct to divide the cool external air and to mix divided parts of the cool external air with the air in the washing tub in stages, and a fan assembly to introduce the air in the washing tub and cool external air into the condensation duct, wherein the fan assembly comprises a fan motor.

The guide duct may mix a part of the cool external air with the air in the washing tub at a middle of a path of the condensation duct.

The condensation duct may include a first introduction hole through which the air in the washing tub is introduced into the condensation duct, and a second introduction hole through which the cool external air is introduced into the condensation duct, and the guide duct may divide the second introduction hole to introduce a designated part of the cool external air into the guide duct.

The condensation duct may further include guide members enabling a part of the air in the washing tub and a part of the cool external air to flow at a path start point of the condensation duct in a width direction of the condensation duct.

The guide members may include a first guide member enabling the air in the washing tub to flow in the width direction of the condensation duct, and a second guide member enabling the cool external air to flow in the width direction of the condensation duct, and a direction of the air in the washing tub flowing through the first guide member may be opposite to a direction of the cool external air flowing through the second guide member.

The condensation duct may further include a first suction duct to guide the air in the washing tub to the condensation duct, and a second suction duct to guide the cool external air to the condensation duct, and the fan assembly may include a first fan housing connecting the first suction duct and the condensation duct, and a first fan to suck the air in the washing tub, and a second fan housing connecting the second suction duct and the condensation duct, and a second fan to suck the cool external air.

The fan motor may drive both the first fan and the second fan.

The dishwasher may further include an opening and closing unit to open and close a path of the first suction duct.

The opening and closing unit may include a valve member, and an actuator to operate the valve member.

The actuator may be a thermal actuator operating the valve member after a designated time from supply of current.

A condensed water separation guide to guide condensed water to the washing tub may be formed in the condensation duct, the condensed water generated by mixing the air in the washing tub and the cool external air.

The dishwasher may further include a condensed water guide to guide the condensed water from the guide duct to the condensed water separation guide.

The washing tub may include a condensed water collection unit to collect the condensed water not guided by the condensed water separation guide.

The foregoing and/or other aspects are achieved by providing a dishwasher including a cabinet, a washing tub provided in the cabinet, a condensation duct to cool air in the washing tub and to discharge the cooled air outside of the dishwasher, the condensation duct including guide members enabling the air in the washing tub and the cool external air introduced into the condensation duct to flow in a width direction of the condensation duct, and a fan assembly introducing the air in the washing tub and cool external air into the condensation duct.

The guide members may include a first guide member enabling the air in the washing tub to flow in the width direction of the condensation duct, and a second guide member enabling the cool external air to flow in the width direction of the condensation duct, and a direction of the air in the washing tub flowing through the first guide member may be opposite to a direction of the cool external air flowing through the second guide member.

The first guide member may include a designated inclination in the flow direction of the air in the washing tub, and the second guide member may include a designated inclination in the flow direction of the cool external air.

The dishwasher may further include a guide duct to divide the cool external air and to mix divided parts of the cool external air with the air in the washing tub in stages.

The foregoing and/or other aspects are achieved by providing a dishwasher including a cabinet, a washing tub provided in the cabinet, a condensation duct to cool air in the washing tub and to discharge the cooled air outside of the dishwasher, the condensation duct including guide members to guide the air in the washing tub and the cool external air introduced into the condensation duct to convert flows of the air in the washing tub and the cool external air into vortexes, and a fan assembly introducing the air in the washing tub and cool external air into the condensation duct.

The foregoing and/or other aspects are achieved by providing a dishwasher including a cabinet, a washing tub provided in the cabinet, a condensation duct to cool air in the washing tub and to discharge the cooled air outside of the dishwasher, and a fan assembly introducing the air in the washing tub and cool external air into the condensation duct, wherein the fan assembly introduces the air in the washing tub and cool external air into the condensation duct using one motor.

The fan assembly may include a first fan housing connecting a first suction duct and the condensation duct, and a first fan provided in the first fan housing to suck the air in the washing tub, and a second fan housing connecting a second suction duct and the condensation duct, and a second fan provided in the second fan housing to suck the cool external air. The first fan housing and the second fan housing may be integrated.

The first fan and the second fan may be driven by the one motor.

The foregoing and/or other aspects are achieved by providing a control method of a dishwasher, the dishwasher including a condensation duct to cool air in a washing tub and to discharge the cooled air outside of the dishwasher, including introducing cool external air into the condensation duct, and introducing the air in the washing tub into the condensation duct, a designated time after the introduction of the cool external air into the condensation duct.

The dishwasher may further include a fan assembly introducing the air in the washing tub and the cool external air into the condensation duct, and an opening and closing unit to open and close a path between the washing tub and the condensation duct, and the opening and closing unit may open the path between the washing tub and the condensation duct, after the fan assembly operates and the designated time.

The dishwasher may further include a first fan introducing the air in the washing tub into the condensation duct, and a second fan introducing the cool external air into the condensation duct, and the cool external air may be introduced into the condensation duct by driving the second fan, and the air in the washing tub may be introduced into the condensation duct by driving the first fan after a designated time.

The dishwasher may further include a fan assembly introducing the air in the washing tub and the cool external air into the condensation duct, and an opening and closing unit to open and close a path between the washing tub and the condensation duct, and the ratio of the air in the washing tub to the cool external air introduced into the condensation duct may be in the range of 1:1~2.2.

Additional aspects, features, and/or advantages of embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
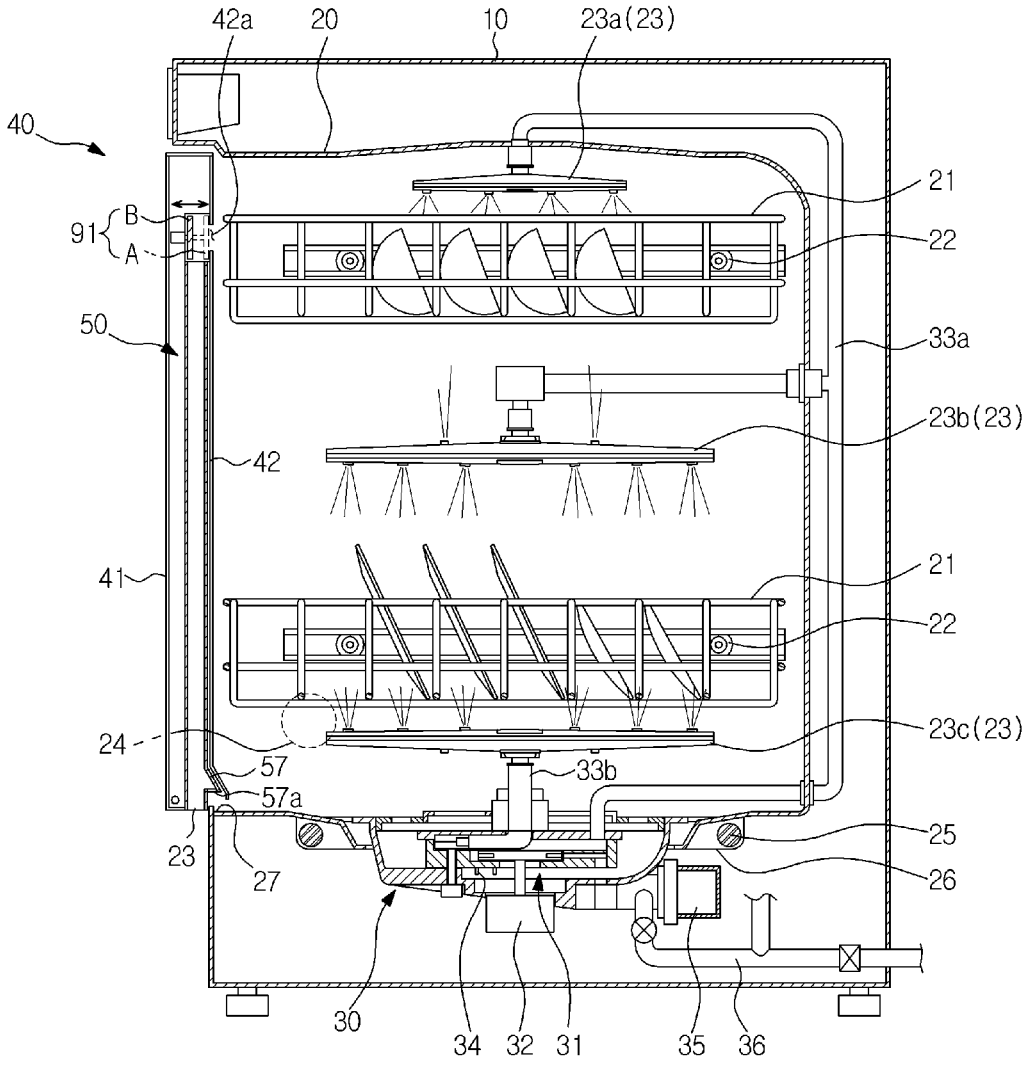
FIG. 1 is a longitudinal-sectional view illustrating main parts of a dishwasher in accordance with example embodiments.

Reference will now be made in detail to the embodiments, examples of which are illustrated in the accompanying drawings, wherein like reference numerals refer to like elements throughout.

FIG. 1 is a longitudinal-sectional view illustrating main parts of a dishwasher in accordance with example embodiments.

As shown in FIG. 1, the dishwasher in accordance with example embodiments may include a cabinet 10, a washing tub 20 provided in the cabinet 10 to form a washing space, a sump 30 provided under the washing tub 20 to store wash water, a door 40 to open and close the front portion of the washing tub 20, and a drying device 50 to dry the inside of the washing tub 20.

The washing tub 20 may be provided with at least one dish basket 21 to receive dishes, at least one rack 22 to slidably support the at least one dish basket 21, and at least one spray nozzle 23 to spray wash water. The at least one spray nozzle 23 may include a top nozzle 23*a*, an upper nozzle 23*b*, and a lower nozzle 23*c*.

A water supply unit 24 to supply wash water may be formed on the washing tub 20. The water supply unit 24 may be provided on the side wall of the washing tub 20. The wash water may be supplied to the inside of the washing tub 20 through the water supply unit 24.

A heater 25 to heat the wash water and a heater installation groove 26 may be formed on the washing tub 20. The heater installation groove 26 may be provided on the bottom of the washing tub 20, and the heater 25 may be installed in the heater installation groove 26.

The sump 30 may be provided at the center of the bottom of the washing tub 20, and serve to collect and then pump the wash water.

The sump 30 may include a washing pump 31 to pump the wash water at a high pressure, and a pump motor 32 to drive the washing pump 31. The washing pump 31 may pump the wash water toward the top nozzle 23*a* and the upper nozzle 23*b* through a first supply pipe 33*a*, and pump the wash water toward the lower nozzle 23*b* through a second supply pipe 33*b*.

The sump 30 further includes a turbidity sensor 34 to detect a pollution level of the wash water. A control unit (not shown) of the dishwasher detects the pollution level of the wash water using the turbidity sensor 34, and then controls the number of times that a washing operation or a rinsing operation may be performed. If the pollution level is high, the number of times that the washing operation or the rinsing operation may be performed is increased, and if the pollution level is low, the number of times that the washing operation or the rinsing operation may be performed is decreased.

A drain pump 35 and a drain pipe 36 to discharge the polluted wash water outside of the dishwasher may be installed at one side of the sump 30.

The door 40 may be rotatably connected to the cabinet 10 to open and close the front portion of the washing tub 20. The door 40 may include a front panel 41 and a rear panel 42, and a designated space may be formed between the front panel 41 and the rear panel 42. Electrical components and the drying device 50 to dry the inside of the washing tub 20 may be installed in the internal space of the door 40.

The drying device 50 may be configured to cool high-temperature and high-humidity air in the washing tub 20 and then to discharge the cooled air outside of the dishwasher. The drying device 50 may be communicated with the inside of the washing tub 20 through a communication hole 42*a* formed through the rear panel 42 of the door 40, and may suck and cool the high-temperature and high-humidity air in the washing tub 20 through the communication hole 42*a* and then discharge the cooled air outside of the dishwasher.

Figure 2:
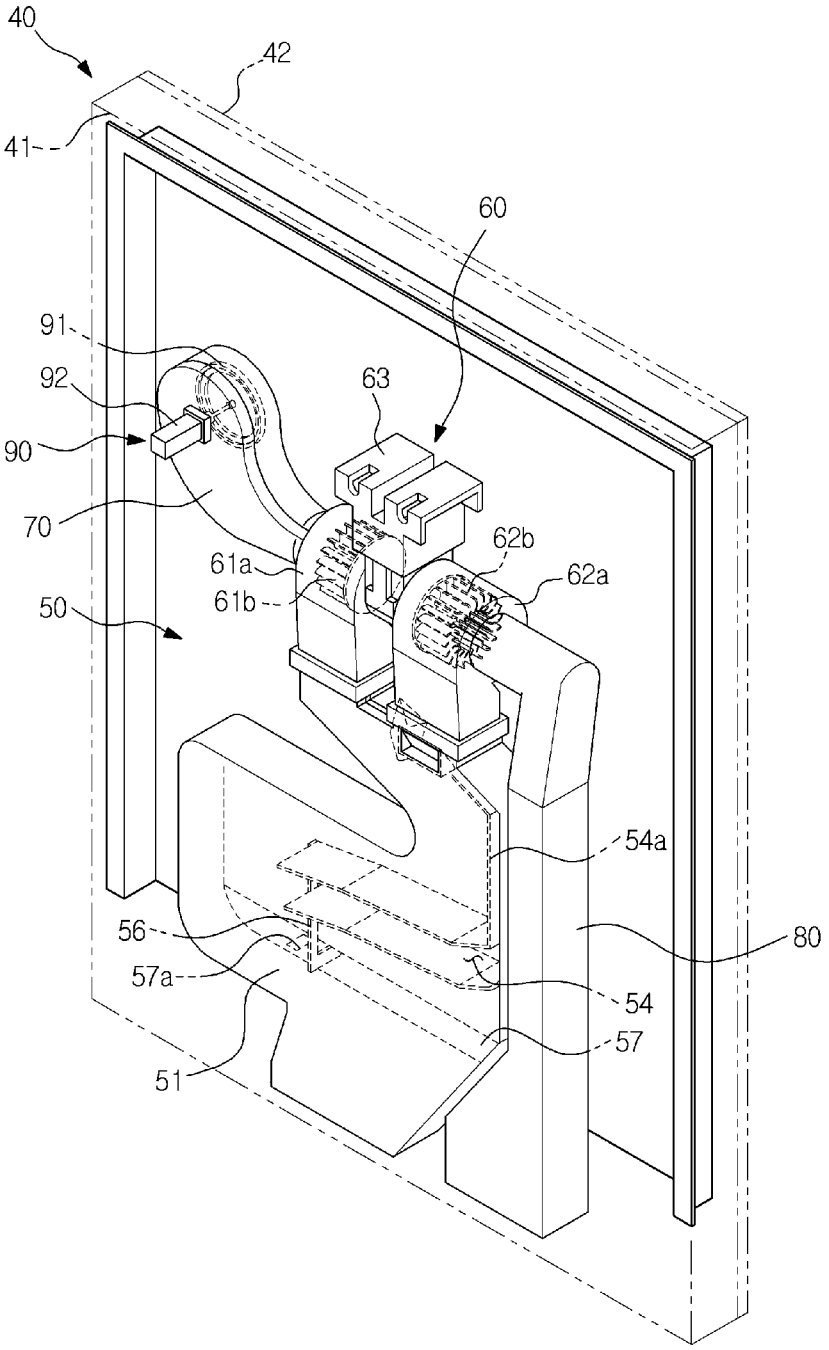
FIG. 2 is a perspective view of a drying device of the dishwasher in an assembled state in accordance with example embodiments.
Figure 3:
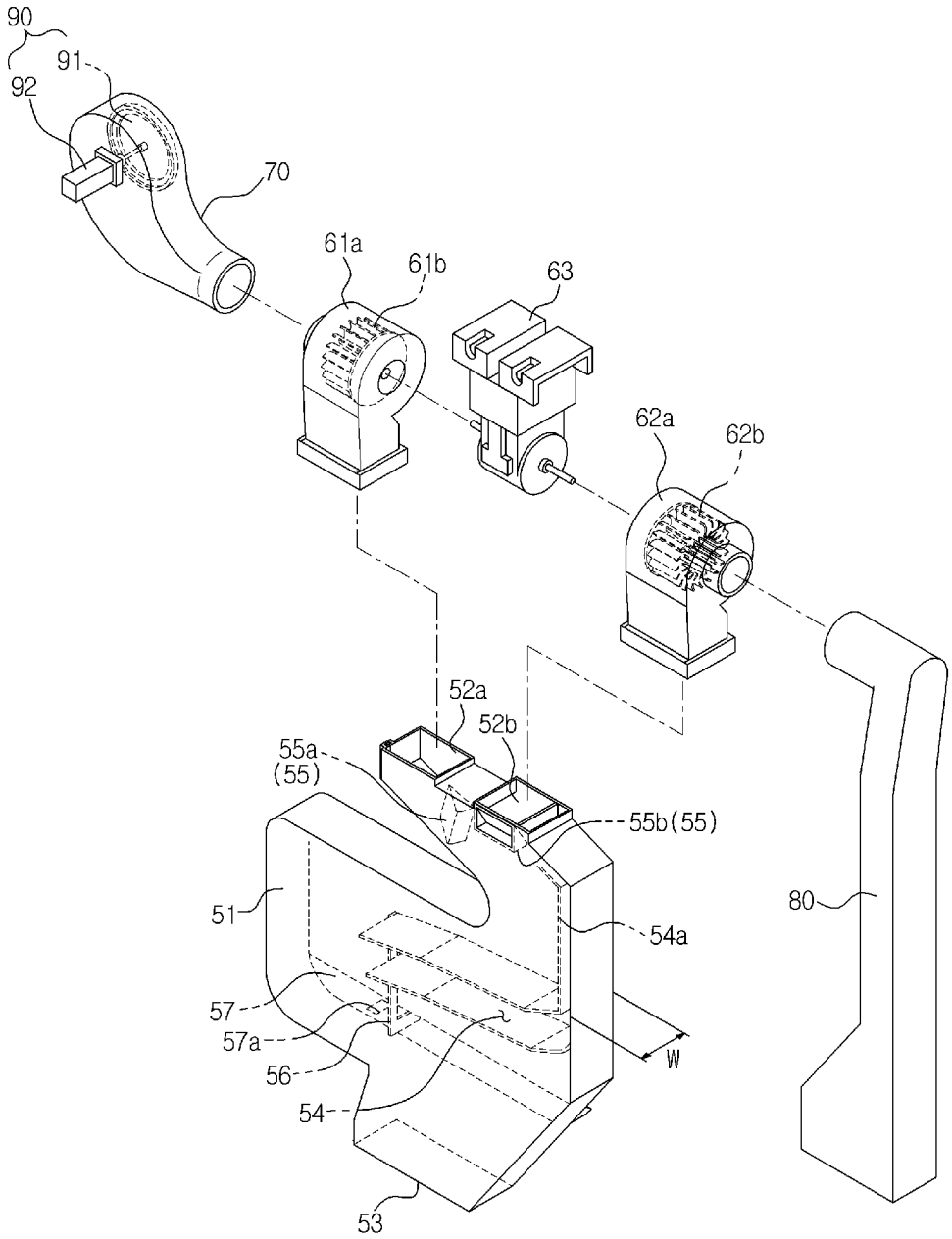
FIG. 3 is an exploded perspective view of the drying device of the dishwasher in accordance with example embodiments.
Figure 4:
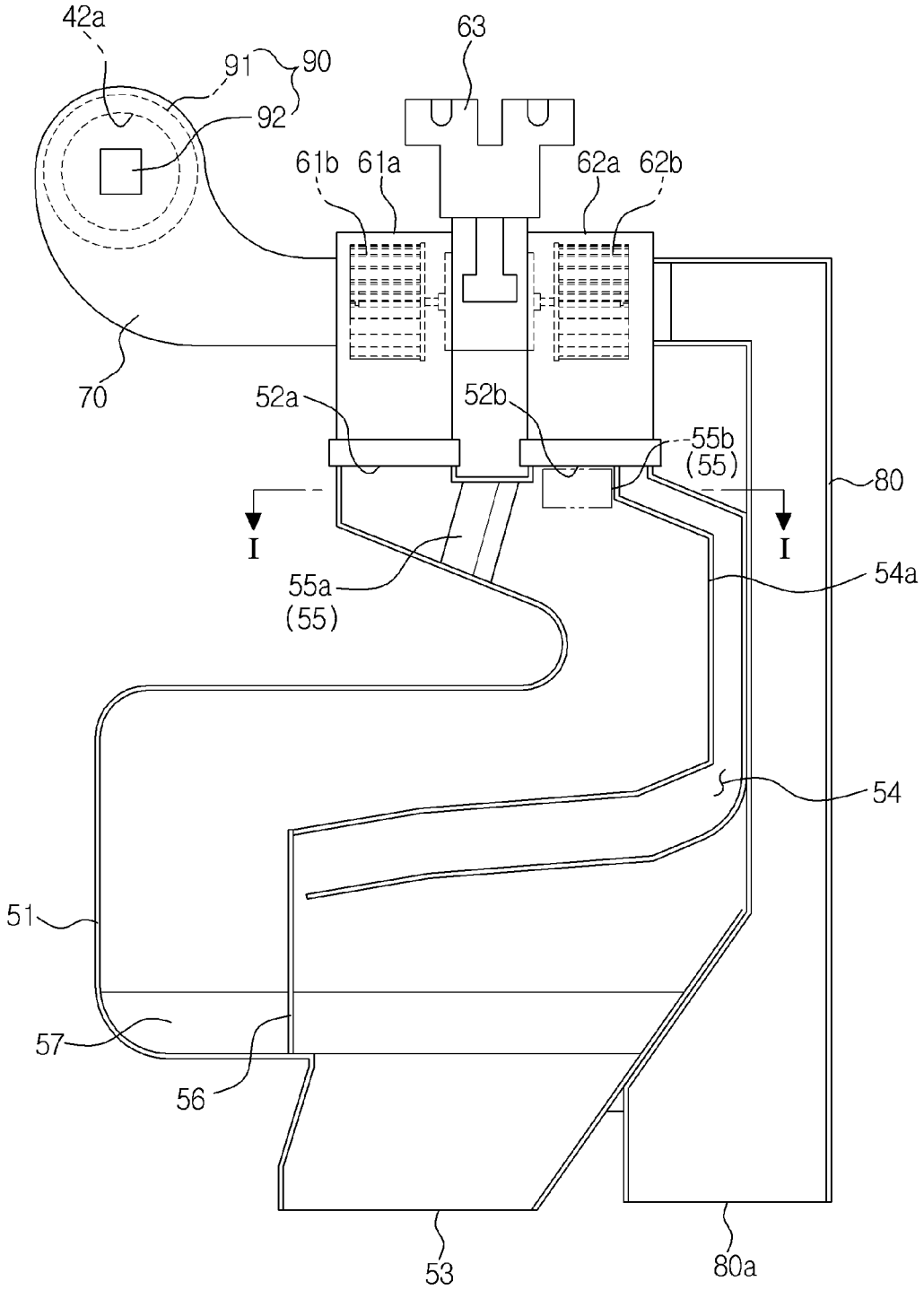
FIG. 4 is a longitudinal-sectional view of the drying device of the dishwasher in accordance with example embodiments.
Figure 5:
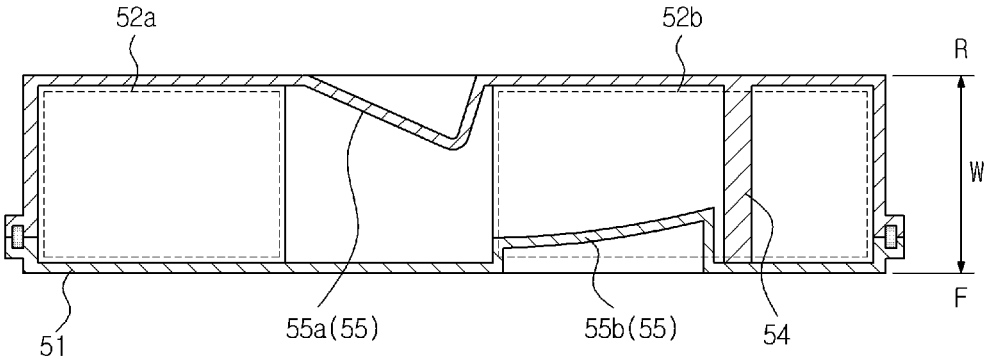
FIG. 5 is a transversal-sectional view taken along the line I-I' of FIG. 4.

FIG. 2 is a perspective view of a drying device of the dishwasher in an assembled state in accordance with example embodiments, FIG. 3 is an exploded perspective view of the drying device of the dishwasher in accordance with example embodiments, FIG. 4 is a longitudinal-sectional view of the drying device of the dishwasher in accordance with example embodiments, and FIG. 5 is a transversal-sectional view taken along the line I-I' of FIG. 4.

As shown in FIGS. 1 to 5, the drying device 50 of the dishwasher may include a condensation duct 51, a fan assembly 60, a first suction duct 70, a second suction duct 80, and an opening and closing unit 90.

The condensation duct 51 may be installed in the vertical direction within the door 40. The condensation duct 51 may be installed within the door 40, and thus a width of the condensation duct 51 may be much smaller than horizontal and vertical lengths of the condensation duct 51. Air in the condensation duct 51 may easily flow in the horizontal direction or the vertical direction, but may not easily flow in the width direction. Further, the condensation duct 51 may approximately have an S-shape, and thus air introduced into the condensation duct 51 may flow downward in a zigzag shape along the S-shape of the condensation duct 51.

The condensation duct 51 may include a first introduction hole 52*a* and a second introduction hole 52*b* at the upper end thereof, and include a discharge hole 53 at the lower end thereof. The high-temperature and high-humidity air in the washing tub 20 may be introduced into the condensation duct 51 through the first introduction hole 52*a*, and cool external air may be introduced into the condensation duct 51 through the second introduction hole 52*b*. Thereafter, the high-temperature and high-humidity air in the washing tub 20 and the cool external air may flow downward in the condensation duct 51 and may be mixed with each other. Then the air mixture is discharged to the outside of the dishwasher through the discharge hole 53. The mixing ratio of the high-temperature and high-humidity air in the washing tub 20 to the cool external air may be set to range from 1:1 to 1:2.2. Such a mixing ratio may be adjusted by the fan assembly 60. The mixing ratio of the high-temperature and high-humidity air in the washing tub 20 to the cool external air may be set to be in the range of 1:1~2.2 by setting fan sizes or motor outputs to be equal or to be different.

The fan assembly 60 may cause the high-temperature and high-humidity air in the washing tub 20 to be introduced into the condensation duct 51, and cause the cool external air to be introduced into the condensation duct 51.

The fan assembly 60 may include a first fan housing 61*a* and a first fan 61*b*, a second fan housing 62*a* and a second fan 62*b*, and a fan motor 63 to drive the first fan 61*b* and the second fan 62*b*. The first fan housing 61*a* and the second fan housing 62*a* may be integrated as one unit.

The first fan housing 61*a* may be configured to connect the first suction duct 70 and the first introduction hole 52*a* of the condensation duct 51. When the first fan 61*b* is operated by the fan motor 63, the high-temperature and high-humidity air in the washing tub 20 may be introduced into the first suction duct 70 through the communication hole 42*a*, and then introduced into the condensation duct 51 through the first introduction hole 52*a*.

The second fan housing 62*a* may be configured to connect the second suction duct 80 and the second introduction hole 52*b* of the condensation duct 51. When the second fan 62*b* is operated by the fan motor 63, the cool external air may be introduced into the second suction duct 80 through a suction hole 80*a*, and then introduced into the condensation duct 51 through the second introduction hole 52*b*.

The opening and closing unit 90 may be configured to open and close the communication hole 42*a*. The opening and closing unit 90 may include a valve member 91, and an actuator 92 to operate the valve member 91. The actuator 92 may operate the valve member 91 to open and close the communication hole 42*a*. If the valve member 91 opens the communication hole 42*a*, the high-temperature and high-humidity air in the washing tub 20 may be sucked into the first suction duct 70, and if the valve member 91 closes the communication hole 42*a*, the high-temperature and high-humidity air in the washing tub 20 may not be sucked into the first suction duct 70.

If the fan assembly 60 is operated when the communication hole 42*a* is closed using the opening and closing unit 90, the first fan 61*b* may be driven but the first suction duct 70 may be closed. Thus the high-temperature and high-humidity air in the washing tub 20 may not be introduced into the first suction duct 70. On the other hand, in this case, the cool external air may be introduced into the condensation duct 51 through the second suction duct 80 by the driving of the second fan 62*b* and thus the condensation duct 51 may be cooled.

Thereafter, if the opening and closing unit 90 opens the communication hole 42*a* after a designated time has elapsed, the first suction duct 70 may be opened and thus the high-temperature and high-humidity air in the washing tub 20 may be introduced into the condensation duct 51 through the opened first suction duct 70 by the driving of the first fan 61*b*.

Through such a structure, the high-temperature and high-humidity air in the washing tub 20 may be mixed with the cool external air in the condensation duct 51 and may be cooled. The actuator 92 may include a thermal actuator. The thermal actuator may be operated after a designated time from supply of current has elapsed. In addition, the actuator 92 may include a rectilinear movement or rotational movement structure including a solenoid valve.

On the other hand, in accordance with example embodiments, the first fan 61*b* and the second fan 62*b* may be driven by respective fan motors. A first fan motor to drive the first fan 61*b* and a second fan motor to drive the second fan 62*b* may be separately provided, and the first fan 61*b* and the second fan 62*b* may each be respectively driven by the first fan motor and the second fan motor. The control unit may first drive the second fan 62*b* so that the cool external air may be introduced into the condensation duct 51 to cool the condensation duct 51, and then, after a designated time has elapsed, may drive the first fan 61*b* so that the high-temperature and high-humidity air in the washing tub 20 may be introduced into the condensation duct 51 and cooled in the cooled condensation duct 51.

The drying device 50 of the dishwasher may further include a guide duct 54 and guide members 55.

The guide duct 54 and the guide members 55 may be installed in the condensation duct 51, and raise mixing efficiency of the high-temperature and high-humidity air in the washing tub 20 and the cool external air in the condensation duct 51.

The guide duct 54 may be divided from the condensation duct 51. A separate partition member 54*a* may be installed in the condensation duct 51, thereby forming the guide duct 54 separate from the condensation duct 51. The guide duct 54 may be arranged adjacent to the second introduction hole 52*b*, and may be connected to a designated part of the second introduction hole 52*b*. A part of the cool external air introduced into the second introduction hole 52*b* may be introduced into the guide duct 54. Thereby, the other part of the cool external air introduced into the second introduced into the second introduction hole 52*b*, which may not be introduced into the guide duct 54, may first mix with the high-temperature and high-humidity air in the washing tub 20 at a path start point of the condensation duct 51, and the part of the cool external air introduced into the second introduction hole 52*b*, which may be introduced into the guide duct 54, move to any point at the middle of the condensation duct 51 along the guide duct 54 and may be secondarily mixed with the high-temperature and high-humidity air in the washing tub 20. As described above, the guide duct 54 may divide the cool external air introduced into the condensation duct 51 through the second introduction hole 52*b*, and the divided parts of the cool external air may be mixed with the high-temperature and high-humidity air in the washing tub 20 in stages.

The guide members 55 may include a first guide member 55*a* arranged adjacent to the first introduction hole 52*a*, and a second guide member 55*b* arranged adjacent to the second introduction hole 52*b*.

The first guide member 55*a* may guide the high-temperature and high-humidity air in the washing tub 20, introduced into the first introduction hole 52*a*, in the width (W) direction of the condensation duct 51, and particularly forward (F) based on the (W) direction of the condensation duct 51. Further, the first guide member 55*a* may have a designated inclination. The flow of the high-temperature and high-humidity air in the washing tub 20 may be converted into vortexes while flowing along the first guide member 55*a* having the designated inclination.

The second guide member 55*b* may guide the cool external air, introduced into the second introduction hole 52*b*, in the width (W) direction of the condensation duct 51, and particularly rearward (R) based on the (W) direction of the condensation duct 51. Further, the second guide member 55*b* may have a designated inclination. The flow of the cool external air may have converted into vortexes while flowing along the second guide member 55*b* having the designated inclination.

Both the high-temperature and high-humidity air in the washing tub 20 may be guided by the first guide member 55*a* and the cool external air guided by the second guide member 55*b* may flow in the width (W) direction of the condensation duct 51, more specifically, may flow in opposite directions based on the width (W) direction of the condensation duct 51 and may be mixed with each other. Therefore, a boundary layer between the high-temperature and high-humidity air in the washing tub 20 and the cool external air may not be formed in a section where the high-temperature and high-humidity air in the washing tub 20 and the cool external air meet.

The width (W) of the condensation duct 51 may be relatively very small, and thus flow resistance of air flowing in the width (W) direction may be greatly increased. Therefore, both the high-temperature and high-humidity air in the washing tub 20 and the cool external air introduced into the condensation duct 51 may flow in opposite directions based on the width (W) direction of the condensation duct 51 through the guide members 55, and mixing efficiency of the high-temperature and high-humidity air in the washing tub 20 and the cool external air may be raised due to the increased flow resistance caused by the small width (W) of the condensation duct 51.

Further, since the flow of the high-temperature and high-humidity air in the washing tub 20 may be converted into vortexes by the first guide member 55*a* and the flow of the cool external air may be converted into vortexes by the second guide member 55*b*, the high-temperature and high-humidity air in the washing tub 20 and the cool external air may be easily mixed with each other.

A condensed water guide 56, to guide condensed water to a condensed water collection unit 27, and a condensed water separation guide 57 may be formed on the condensation duct 51.

The high-temperature and high-humidity air in the washing tub 20 may first be mixed with the cool external air at the path start point of the condensation duct 51. There may be a temperature difference between the high-temperature and high-humidity air in the washing tub 20 and the cool external air, and thus the high-temperature and high-humidity air in the washing tub 20 may be cooled to generate condensed water. The condensed water may moves downward along the external surface of the partition member 54*a* of the guide duct 54.

Thus, the condensed water guide 56 may be connected to the lower end of the partition member 54*a* of the guide duct 54. The condensed water guide 56 may guide the condensed water, descending along the external surface of the partition member 54*a* of the guide duct 54, to the condensed water separation guide 57.

The condensed water separation guide 57 may be provided at a point before the condensed water reaches the discharge hole 53 of the condensation duct 51. The condensed water separation guide 57 may be depressed toward a direction of the washing tub 20 at a designated position of the condensation duct 51. The condensed water descending along the condensed water guide 56 may flow to the depressed condensed water separation guide 57. At this time, the air mixture may be discharged to the outside of the dishwasher through the discharge hole 53 of the condensation duct 51.

A condensed water separation hole 57*a* may be formed through the condensed water separation guide 57. The condensed water separated from the air mixture by the condensed water separation guide 57 may drop down to the condensed water collection unit 27 through the condensed water separation hole 57*a*.

The condensed water collection unit 27 may be formed on the bottom of the washing tub 20. Thereby, the condensed water collected in the condensed water collection unit 27 through the condensed water guide 56 and the condensed water separation guide 57 may be introduced into the washing tub 20.

Hereinafter, operation of the dishwasher in accordance with the example embodiments will be described.

A user may open the door 40, and pull at least one dish basket 21 out of the washing tub 20. Thereafter, the user may put dishes into the at least one dish basket 21, and push the at least one dish basket 21 back into the washing tub 20. Thereafter, the user may close the door 40, and turn on the dishwasher.

When a washing operation may be performed when power is applied to the dishwasher, wash water may be introduced into the sump 30 through the water supply unit 24. When the supply of wash water is completed, the pump motor 32 may operate the wash pump 31. The wash water pumped by the wash pump 31 may be supplied to the top nozzle 23*a* and the upper nozzle 23*b* through the first supply pipe 33*a* and may then be sprayed, and may be supplied to the lower nozzle 23*c* through the second supply pipe 33*b* and sprayed. The dishes in the at least one dish basket 21 may be washed by the sprayed wash water.

The wash water polluted during the washing operation may again be collected in the sump 30. Foreign substances may be filtered out from the wash water collected in the sump 30 by a filter. When the washing operation is completed and a draining operation is started, the wash water, from which the foreign substances have been filtered out, may be discharged outside of the dishwasher through the drain pump 35 and the drain pipe 36.

Thereafter, wash water may again be introduced into the sump 30 through the water supply unit 24, the sump 30 may pump the wash water to the spray nozzles 23, the spray nozzles 23 may spray the wash water to wash the dishes, and then the drain pump 35 may discharge the polluted wash water outside of the dishwasher. A rinsing operation may also be performed in such a manner.

The number of times that the washing operation or the rinsing operation may be performed is controlled according to the pollution level of the wash water detected by the turbidity sensor 34.

When the washing operation and the rinsing operation are completed, a drying operation may be performed. Thereby, the operation of the dishwasher may be completed. Hereinafter, the drying operation of the dishwasher in accordance with the example embodiments will be described.

Figure 6:
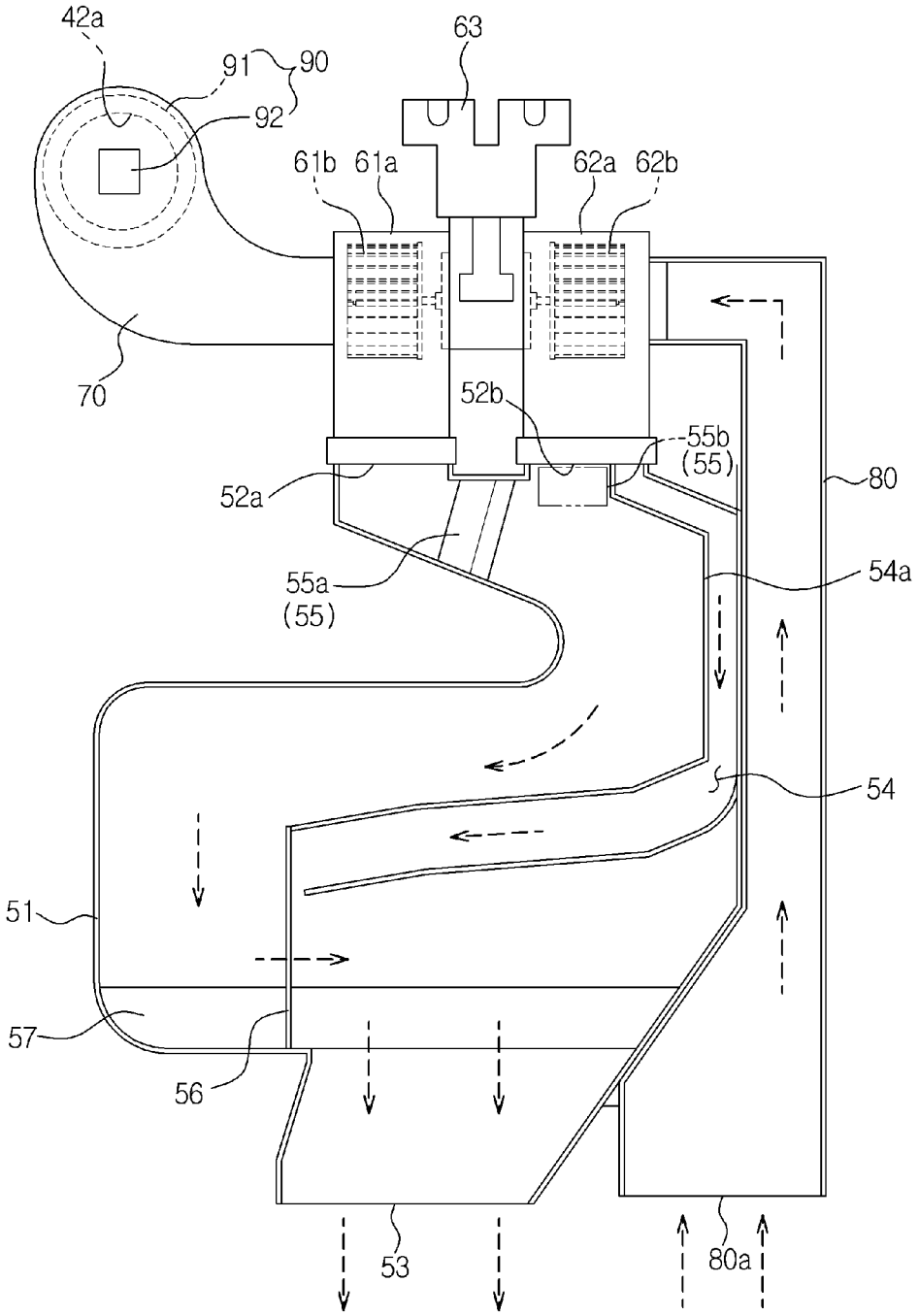
FIG. 6 is a view illustrating an air flow before a first suction duct is opened in the drying device of the dishwasher in accordance with example embodiments.
Figure 7:
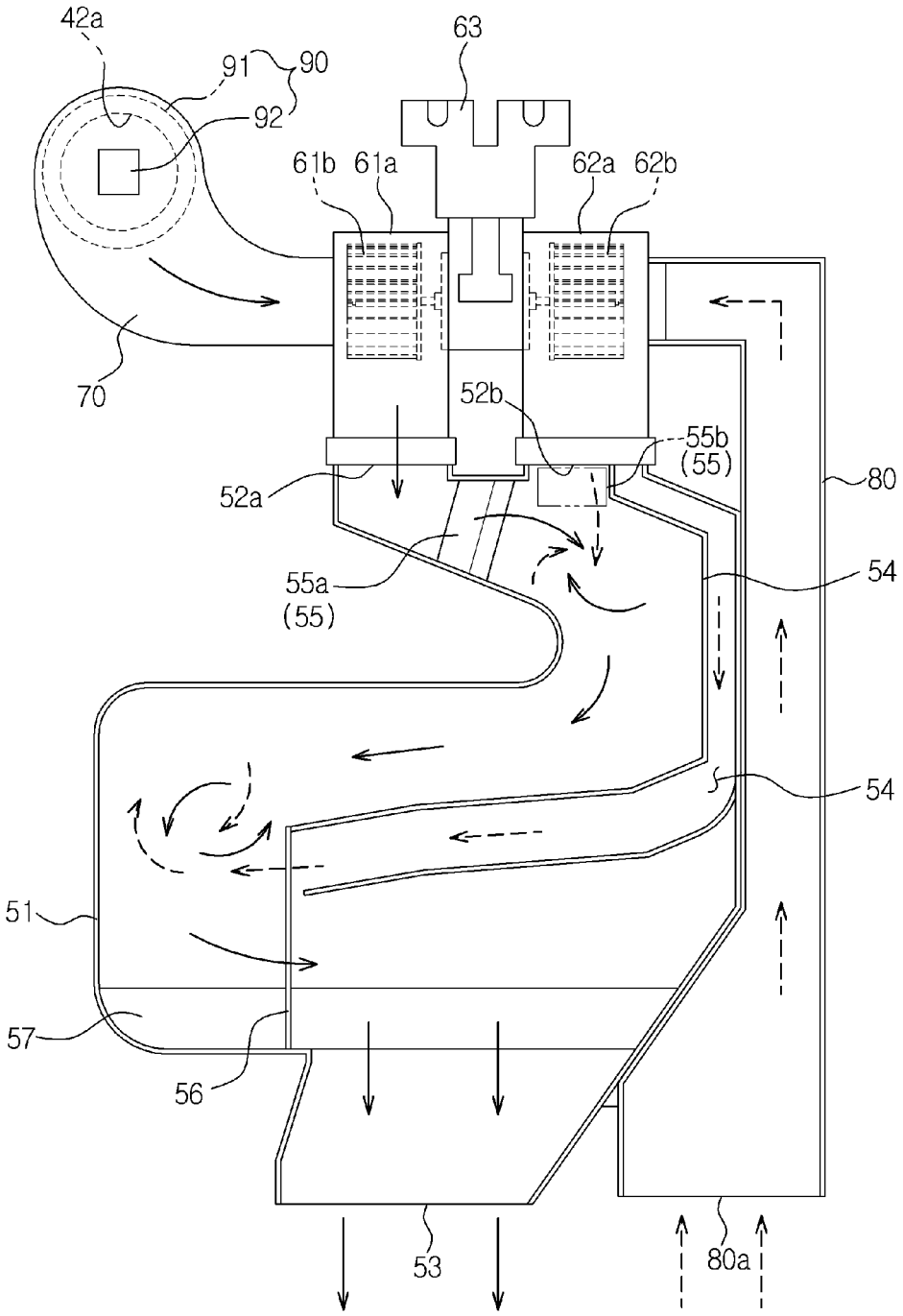
FIGS. 7 and 8 are views illustrating an air flow after the first suction duct is opened in the drying device of the dishwasher in accordance with example embodiments.
Figure 8:
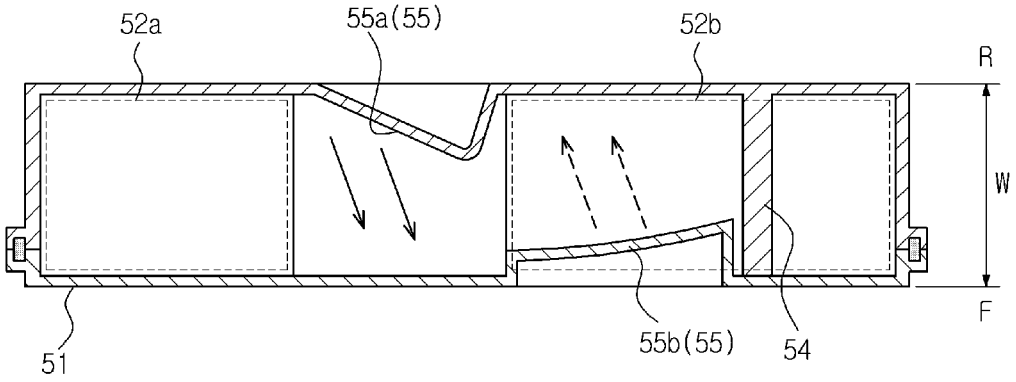
Figure 9:
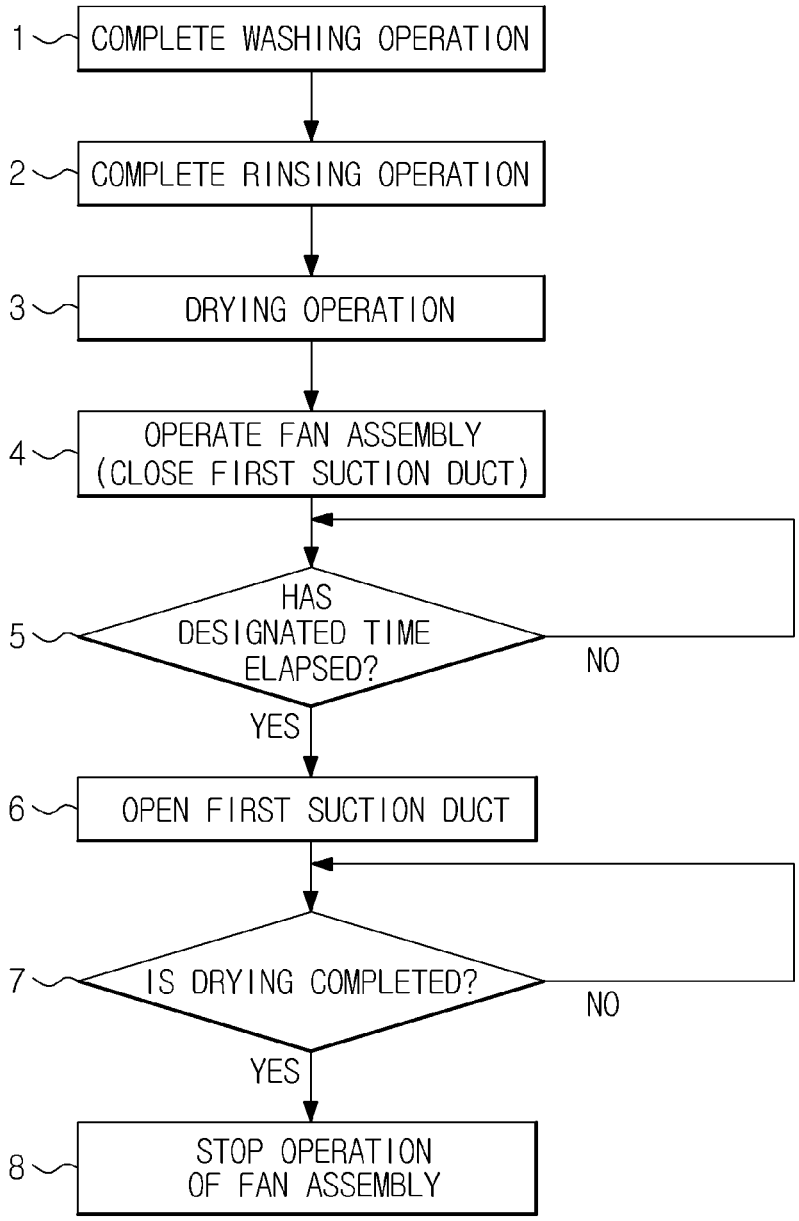
FIG. 9 is a flow chart illustrating an operating process of the drying device of the dishwasher in accordance with example embodiments.

FIG. 6 is a view illustrating an air flow before the first suction duct may be opened in the drying device of the dishwasher in accordance with example embodiments, FIGS. 7 and 8 are views illustrating an air flow after the first suction duct may be opened in the drying device of the dishwasher in accordance with example embodiments, and FIG. 9 is a flow chart illustrating an operating process of the drying device of the dishwasher in accordance with example embodiments.

As shown in FIGS. 1 to 9, when the washing operation 1 and the rinsing operation 2 are completed, high-temperature and high-humidity air may be formed in the washing tub 20. Thereafter, during the drying operation 3, the drying device 50 may cool the high-temperature and high-humidity air in the washing tub 20, and then discharge the cooled air outside of the dishwasher.

As shown in FIG. 6, when the fan assembly 60 is first operated, cool external air may be introduced into the condensation duct 51 through the second suction duct 80, and cool the condensation duct 51 in operation 4. Here, since the valve member 91 is located at the position A of FIG. 1 and closes the communication hole 42*a*, the high-temperature and high-humidity air in the washing tub 20 may not be introduced into the condensation duct 51.

As shown in FIGS. 7 and 8, when a designated time has elapsed 5 and the valve member 91 is located at the position B of FIG. 1 and opens the communication hole 42*a*, the high-temperature and high-humidity air in the washing tub 20 may be introduced into the condensation duct 51 through the first suction duct 70. The high-temperature and high-humidity air in the washing tub 20 introduced into the condensation duct 51 may be first mixed with a part of the cool external air at the path start point of the condensation duct 51 by the guide duct 54, and may be secondarily mixed with the remaining part of the cool external air at the middle of the path of the condensation duct 51. The high-temperature and high-humidity air in the washing tub 20 may be mixed with the cool external air in stages, cooled, and then discharged outside of the dishwasher through the discharge hole 53.

Further, the high-temperature and high-humidity air in the washing tub 20 and the cool external air may be guided at the path start point of the condensation duct 51 in the width (W) direction of the condensation duct 51 through the guide members 55, and may be efficiently mixed with each other.

Thereafter, it may be judged whether or not drying of the dishes is complete 7, and the fan assembly 60 may be stopped according to a result of the judgment 8. It may be determined whether drying of the dishes is completed by determining whether a predetermined drying time elapses, or may be judged through quantitative analysis of temperature or humidity using a temperature sensor or a humidity sensor.

Thereby, since air discharged through the discharge hole 53 of the condensation duct 51 is not additionally condensed, formation of water drops around the discharge hole 53 may not occur. Further, since the air is discharged after the temperature of the air is lowered, a burn hazard may be prevented.

As is apparent from the above description, in a dishwasher and a control method thereof in accordance with example embodiments, air in the dishwasher is maximally cooled and is then discharged outside of the dishwasher.

Further, the structure of a fan assembly is improved, thereby achieving cost reduction and increasing space utility.

Although embodiments have been shown and described, it should be appreciated by those skilled in the art that changes may be made in these embodiments without departing from the principles and spirit of the disclosure, the scope of which is defined in the claims and their equivalents.

What is claimed is:

1. A dishwasher, comprising:

a cabinet;

a washing tub provided at an inside of the cabinet;

a spray nozzle configured to spray wash water inside the washing tub; and a door configured to open and close a front of the washing tub, the door including a drying device configured to cool high-temperature/high-humidity air from the washing tub and then to discharge the cooled air outside of the dishwasher, wherein the drying device includes a condensation duct to condense the high-temperature/high-humidity air from the washing tub;

a first fan to draw in air from the washing tub and discharge the air to the condensation duct, the first fan drawing the air from the washing tub through a first suction duct;

a second fan to draw in external air and discharge the external air to the condensation duct, the second fan drawing the external air from outside of the dishwasher through a second suction duct;

a fan motor to drive the first fan and the second fan, the motor being disposed between the first fan and the second fan to separate the first fan and the second fan;

a first fan housing configured to accommodate the first fan and to guide air from the first fan in a first direction; and a second fan housing configured to accommodate the second fan and to guide air from the second fan in the first direction.

2. The dishwasher according to claim 1, wherein the condensation duct includes a partition member installed in the condensation duct, the partition member forming a guide duct configured to guide only a part of the external air to a middle of a path of the condensation duct.

3. The dishwasher according to claim 1, wherein the fan motor has a driving shaft coupled to the first fan and the second fan such that an air flowing direction to the first fan is opposite to an air flowing direction to the second fan.

4. The dishwasher according to claim 3, further comprising an opening and closing unit configured to open and close the first suction duct, the opening and closing unit including a valve member and an actuator to operate the valve member to open and close the first suction duct.

5. The dishwasher according to claim 1, wherein the fan motor is disposed between the first fan and the second fan to separate the first fan and the second fan, and the fan motor is disposed between the first suction duct and the second suction duct.

* * * * *